United States Patent [19]

Harandi et al.

[11] Patent Number: 5,043,499

[45] Date of Patent: Aug. 27, 1991

[54] FLUID BED OLIGOMERIZATION OF OLEFINS

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 480,697

[22] Filed: Feb. 15, 1990

[51] Int. Cl.[5] ..... C07C 2/12

[52] U.S. Cl. ..... 585/301; 585/330; 585/533

[58] Field of Search ..... 585/517, 533, 304, 319, 585/307; 208/155

[56] References Cited

U.S. PATENT DOCUMENTS

| | | | |
|---|---|---|---|
| 3,960,978 | 6/1976 | Givens et al. | 260/683.15 R |
| 4,090,949 | 5/1978 | Owen et al. | 208/78 |
| 4,433,185 | 2/1984 | Tabak | 585/315 X |
| 4,456,779 | 6/1984 | Owen et al. | 585/314 X |
| 4,487,985 | 12/1984 | Tabak | 585/517 |
| 4,497,968 | 2/1985 | Wright et al. | 585/533 X |
| 4,606,810 | 8/1986 | Krambeck et al. | 208/155 |
| 4,746,762 | 5/1988 | Avidan et al. | 585/533 X |
| 4,822,477 | 4/1989 | Avidan et al. | 585/407 |
| 4,831,203 | 5/1989 | Owen et al. | 585/519 |

*Primary Examiner*—Anthony McFarlane

*Attorney, Agent, or Firm*—A. J. McKillop; C. J. Speciale; L. G. Wise

[57] ABSTRACT

A continuous multistage process for converting normally gaseous olefins containing an amount of ethene to gasoline and/or distillate range hydrocarbons, the process employing at least two fluidized olefins oligomerization reaction zones operating in parallel with one reaction zone operating under high severity reaction conditions effective for converting ethene.

19 Claims, 1 Drawing Sheet

FIG.
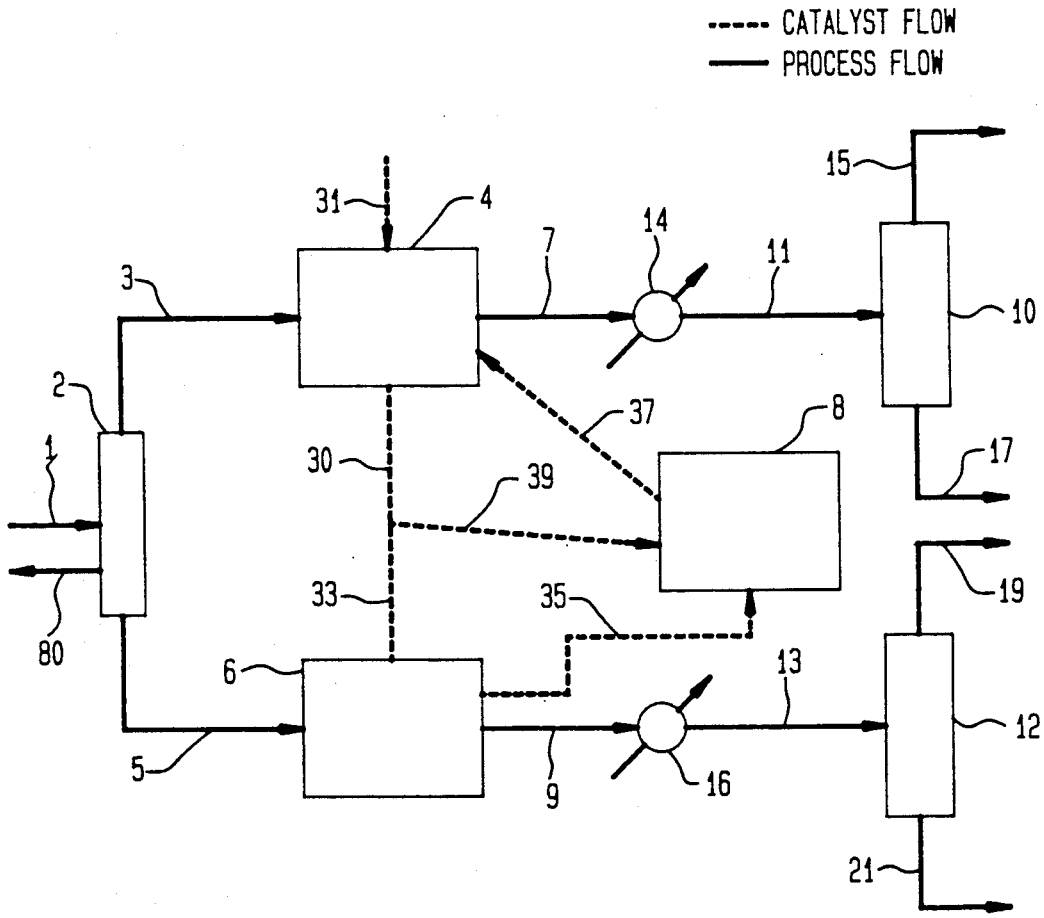

FLUID BED OLIGOMERIZATION OF OLEFINS

BACKGROUND OF THE INVENTION

This invention relates to olefin upgrading by fluidized bed catalysis.

Developments in zeolite catalysis and hydrocarbon conversion processes have created interest in utilizing olefinic feedstocks for producing $C_5$+ gasoline, diesel fuel, etc. In addition to basic chemical reactions promoted by medium pore ZSM-5 type shape selective zeolite catalysts, a number of discoveries have contributed to the development of new industrial processes. These are safe, environmentally acceptable processes for utilizing feedstocks, that contain lower olefins, especially $C_2$–$C_4$ alkenes. Conversions of $C_2$–$C_4$ alkenes and alkanes to produce aromatics-rich liquid hydrocarbon products were found by Cattanach (U.S. Pat. No. 3,760,024) and Yan et al (U.S. Pat. No. 3,845,150) to be effective processes using the ZSM-5 type zeolite catalysts. In U.S. Pat. Nos. 3,960,978 and 4,021,502, Plank, Rosinski and Givens disclose conversion of $C_2$–$C_5$ olefins, alone or in admixtures with paraffinic components, into higher hydrocarbons over crystalline zeolites having controlled acidity. Garwood et al. have also contributed to the understanding of catalytic olefin upgrading techniques and improved processes as in U.S. Pat. Nos. 4,150,062, 4,211,640 and 4,227,992. The above-identified disclosures are incorporated herein by reference.

Conversion of lower olefins, especially propene (propylene) and butenes, over HZSM-5 is effective at moderately elevated temperatures and pressures. The conversion products are sought as liquid fuels, especially the $C_5$+ aliphatic and aromatic hydrocarbons. Product distribution for liquid hydrocarbons can be varied by controlling process conditions, such as temperature, pressure and space velocity. Gasoline ($C_5$–$C_{10}$) is readily formed at elevated temperature—e.g., from about 250° C. to 700° C. (preferably 300° C. to 500° C.) and moderate pressure from ambient to about 5500 kPa (preferably about 250 to 2900 kPa). Olefinic gasoline can be produced in good yield and may be recovered as a product or fed to a low severity, high pressure reactor system for further conversion to heavier distillate-range products.

Distillate mode operation can be employed to maximize production of $C_{10}$+ aliphatics by reacting the lower and intermediate olefins at high pressure and moderate temperature. Operating details for typical "MOGD" oligomerization units are disclosed in U.S. Pat. Nos. 4,456,779; 4,497,968 (Owen et al) and 4,433,185 (Tabak), incorporated herein by reference. At moderate temperature and relatively high pressure, the conversion conditions favor distillate-range product having a boiling point of at least 165° C. (330° F.). Lower olefinic feedstocks containing $C_2$–$C_6$ alkenes may be converted selectively; however, the low severity distillate mode conditions do not convert a major fraction of ethene (ethylene). While propene, butene-1, and others may be converted to the extent of 70% to 99% in the lower severity moderate temperature distillate mode, only about 10% to 30% of the ethene component will be converted using HZSM-5 or similar acid zeolites. Many feedstocks of commercial interest, such as FCC offgas, dehydrogenation products, ethane cracking by-products, etc., contain both ethene and hydrogen along with $H_2S$ and light aliphatics. Ethene can also be converted at moderate temperature with a bifunctional nickel catalyst. In conventional processes of upgrading FCC light gas containing amounts of ethene, propene and butenes; the entire FCC fuel gas and $C_3$–$C_4$ product is added directly to a reaction system. Such processes require gas plant fractionation to recover propane and butanes from the reaction system effluent. In a typical operation, about 20% to 70% of the $C_3$–$C_4$ alkanes in the effluent are not easily recoverable. Such a disadvantage is serious because an objective in employing catalytic fuel gas upgrading units is to reduce FCC fuel gas make. It has been found that ethene-containing light gas can be upgraded to liquid hydrocarbons rich in isobutane and gasoline or BTX by catalytic conversion in a turbulent fluidized bed of solid acid zeolite catalyst under high severity reaction conditions in a single pass or with recycle of gas product. This technique is particularly useful for upgrading FCC light gas, which usually contains significant amounts of ethene, propene, paraffins and hydrogen produced in cracking heavy petroleum oils and the like. By upgrading the by-product light gas, gasoline yield of FCC units can be significantly increased. Accordingly, it is a primary object of the present invention to provide a novel technique for upgrading ethene-containing light gas. U.S. Pat. No. 4,090,949 (Owen et al) discloses dual riser reactors operating in parallel and containing zeolite catalyst particles obtained from a common regeneration zone. A gas oil feed material is contacted with catalyst in a first riser reactor and a $C_2$–$C_5$ olefinic stream is contacted with catalyst in a second riser reactor. Hydrogen contributors are injected into both riser reactors at multiple positions along each riser.

U.S. Pat. No. 4,456,779 (Owen et al) discloses a process for upgrading $C_2$–$C_5$ olefinic feedstocks in a reaction zone containing zeolite ZSM-5 catalyst particles. The feedstock is mixed initially with a recycled $C_2$–$C_4$ paraffinic material obtained from a debutanizer.

U.S. Pat. No. 4,487,985 (Tabak) discloses a reactor sequencing technique useful for multi-stage hydrocarbon conversion systems. Fixed bed catalytic reactors are employed. Catalyst partially inactivated in a primary stage is employed in a secondary stage to effect hydrocarbon conversion at a higher temperature.

U.S. Pat. No. 4,497,968 (Wright et al) discloses a multistage process for converting lower olefins to gasoline boiling range hydrocarbons. An olefinic feedstock is prefractionated to obtain an ethene containing stream and a stream comprising $C_3$+ olefins such as propene, butene and the like. The ethene-containing stream is added to a high severity reaction system and the $C_3$+ olefinic stream is added to a distillate mode reaction system. In a preferred embodiment, the olefinic feedstock is obtained from an oxygenates conversion reaction system such as the methanol to-olefins (MTO) process. The distillate mode reaction system preferably comprises a series of fixed bed reactors.

U.S. Pat. No. 4,831,203 (Owen et al) discloses a fluidized bed process for upgrading ethene-containing hydrocarbons to gasoline products. All of the references listed above are incorporated herein by reference.

In the process for catalytic conversion of olefins to heavier hydrocarbons by catalytic oligomerization using an acid crystalline zeolite, such as catalyst having the structure of ZSM-5, process conditions can be varied to favor the formation of either gasoline or distillate range products. At moderate temperature and relatively high pressure, the conversion conditions favor distillate range product having a normal boiling point of at least 165° C. (330° F.). Lower olefinic feedstocks containing $C_2$–$C_6$ alkenes may be converted selectively; however, the distillate mode conditions do not convert a major fraction of ethylene.

In the gasoline mode, ethylene and the other lower olefins are catalytically oligomerized at higher temperature and moderate pressure. However, coking of the catalyst is accelerated by the higher temperature. Under these conditions ethylene conversion rate is greatly increased and lower olefin conversion is nearly complete to produce an olefinic gasoline comprising pentane, pentene and $C_6$+ hydrocarbons in good yield. To avoid excessive temperatures in the exothermic reactors, the lower olefinic feed may be diluted. In the distillate mode operation, olefinic gasoline may be recycled and further oligomerized, as disclosed in U.S. Pat. No. 4,211,640 (Garwood and Lee). In either mode, the diluent may contain light hydrocarbons, such as $C_3$–$C_4$ alkanes, present in the feedstock and/or recycled from the debutanized product. In U.S. Pat. No. 4,433,185 (Tabak), incorporated herein by reference, a two stage catalytic process is disclosed for converting lower olefins at elevated temperature and pressure, with unconverted reactant, mainly ethylene, from a first stage being completely converted at higher temperature in a second stage. Although, the same type catalyst (H-ZSM-5) is employed in each stage, significant differences in operating temperatures and catalyst use contribute to different rates of inactivation, largely due to coking.

The present invention takes advantage of the accelerated aging rate for hydrocarbon conversion catalyst operating under process conditions which produce coke deposits. Increased coking decreases conversion at a given temperature, and it is conventional practice to increase process temperature to maintain the desired level of conversion. In the olefins oligomerization process contemplated in the preferred embodiment herein, partially deactivated coked catalyst from a high severity reaction zone is transferred to a low severity reaction zone operating in parallel. The partially deactivated catalyst retains enough acid activity to convert more reactive olefins under low severity conditions. In a preferred embodiment, highly active ZSM-5 type catalyst is used in the high severity reaction zone for conversion of ethylene ($C_2H_4$ ethene). When the ZSM-5 type catalyst is deactivated to a point below which efficient conversion of ethene can be achieved, the catalyst or a portion thereof is removed to the low severity reaction zone for contact with more reactive olefins such as propene, butene and the like. Under low severity conditions $C_3$+ olefinic reactants are efficiently converted in major amount to gasoline product.

SUMMARY OF THE INVENTION

An improved process is disclosed for continuous conversion of ethene-containing feedstock to heavier hydrocarbon products such as gasoline, distillate and the like wherein the feedstock is contacted with fluidized zeolite catalysts under oligomerization conditions. The improvement comprises separating the feedstock into a $C_2$ hydrocarbon stream rich in ethene and a $C_3$–$C_4$ olefinic hydrocarbon stream. The ethene-rich stream is added to a high severity fluidized bed reaction zone operating under conditions sufficient to oligomerize ethene by contacting with acid zeolite catalyst particles. The $C_3$–$C_4$ olefinic stream containing propene, butene and the like is added to a low severity fluidized bed reaction zone containing acid zeolite catalyst particles and operating under conditions which yield only a minor amount of methane and ethane cracking products. The process further comprises withdrawing an amount of partially coked and deactivated zeolite catalyst from the high severity reaction zone. At least a portion of withdrawn catalyst is added to the low severity zone where it is employed for the efficient conversion of $C_3$–$C_4$ olefins to heavier hydrocarbon products.

Broadly, the present continuous process for upgrading lower olefins comprises adding a primary stream comprising relatively unreactive olefins to a primary fluidized reaction zone comprising solid crystalline zeolite catalyst particles in a reactor, preferably operating under turbulent regime high severity conditions. A secondary stream comprising readily reactive olefins is added to a secondary fluidized reaction zone comprising solid crystalline zeolite catalyst particles in a reactor, also preferably operating under turbulent regime low severity conditions. A portion of partially deactivated catalyst particles is withdrawn from the primary high severity fluidized reaction zone and added to the secondary low severity fluidized reaction zone where said portion contacts readily reactive olefins.

In a preferred embodiment, a common regeneration system is employed for the high severity and low severity reaction zones. Most preferably, the regeneration system comprises a common regenerator and stripper. In addition, an integrated product recovery system is used. A common gasoline debutanizer or product liquid filter is an essential part of the integrated product recovery system. Preferably, the regeneration system is operated at equal or lower pressure than the high severity and low severity reaction zones.

THE DRAWING

The single FIGURE is process flow sheet showing the major unit operations, process streams and catalyst flow.

DETAILED DESCRIPTION OF THE INVENTION

Catalyst versatility permits the same zeolite to be used in both the high severity fluidized reaction zone and the low severity reaction zone. While it is within the inventive concept to employ substantially different catalysts in these zones, it is advantageous to employ a standard ZSM-5 having a silica:alumina molar ratio of about 25:1 to 70:1.

Oligomerization catalysts preferred for use herein include the medium pore shape selective crystalline aluminosilicate zeolites having a silica:alumina ratio of at least 12, a constraint index of about 1 to 12 and acid cracking activity of about 1 to 250. Representative of the ZSM-5 type zeolites are ZSM-5, ZSM-11, ZSM-12, ZSM-22, ZSM-23, ZSM-35 and ZSM-48. ZSM-5 is disclosed in U.S. Pat. No. 3,702,886 and U.S. Pat. No. Re. 29,948. Other suitable zeolites are disclosed in U.S. Pat. Nos. 3,709,979; 3,832,449; 4,076,979; 3,832,449; 4,076,842; 4,016,245; 4,046,839; 4,414,423 and 4,417,086. The disclosures of these patents are incorporated herein by reference. A typical zeolite catalyst component having Bronsted acid sites may consist essentially of aluminosilicate ZSM-5 zeolite with 5 to 95 wt. % silica and/or alumina binder.

These siliceous zeolites may be employed in their acid forms, ion exchanged or impregnated with one or more suitable metals, such as Ga, Pd, Zn, Ni, Co and/or other metals of Periodic Groups III to VIII. The zeolite may include a hydrogenation-dehydrogenation component (sometimes referred to as a hydrogenation component) which is generally one or more metals of Group IB, IIB, IIIB, VA, VIA or VIIIA of the Periodic Table (IUPAC), especially aromatization metals such as Ga, Pd, etc. Useful hydrogenation components include the noble metals of Group VIIIA, especially platinum, but other noble metals, such as palladium, gold, silver, rhenium, or rhodium may also be used. Base metal hydrogenation components may also be used, especially nickel, cobalt, molybdenum, tungsten, copper or zinc. The catalyst material may include two or more catalytic components, such as metallic oligomerization component (e.g., ionic $Ni^{+2}$ and a shape-selective medium pore acidic oligomerization catalyst, such as ZSM-5 zeolite) which components may be present in admixture or combined in a unitary bifunctional solid particle. It is possible to utilize an ethene dimerization metal or oligomerization agent to effectively convert feedstock ethene in a continuous reaction zone.

Certain ZSM-5 type medium pore shape selective catalyst are sometimes known as pentasils. In addition to the preferred aluminosilicates, the borosilicate, ferrosilicate and "silicalite" materials may be employed. It is advantageous to employ a standard ZSM-5 having a silica:alumina molar ratio of 25:1 to 70:1 with an apparent alpha value of 10–80 to convert 60 to 100 percent, preferably at least 70%, of the olefins in the feedstock.

ZSM-5 type pentasil zeolites are particularly useful in the process because of their regenerability, long life and stability under extreme conditions of operation. Usually the zeolite crystals have a crystal size from about 0.01 to over 2 microns or more, with 0.02–1 micron being preferred. In order to obtain the desired particle size for fluidization in the turbulent regime, the zeolite catalyst crystals are bound with a suitable inorganic oxide, such as silica, alumina, etc. to provide a zeolite concentration of about 5 to 95 wt %. In the description of preferred embodiments a 25% H-ZSM-5 catalyst contained within a silica-alumina matrix and having a fresh alpha value of about 80 is employed unless otherwise stated.

Particle size distribution can be a significant factor in achieving overall homogeneity in turbulent regime fluidization. It is desired to operate the process with particles that will mix well throughout the bed. Large particles having a particle size greater than 250 microns should be avoided, and it is advantageous to employ a particle size range consisting essentially of 1 to 150 microns. Average particle size is usually about 20 to 100 microns, preferably 40 to 80 microns. Particle distribution may be enhanced by having a mixture of larger and smaller particles within the operative range, and it is particularly desirable to have a significant amount of fines. Close control of distribution can be maintained to keep about 10 to 25 wt % of the total catalyst in the reaction zone in the size range less than 32 microns. This class of fluidizable particles is classified as Geldart Group A. Accordingly, the fluidization regime is controlled to assure operation between the transition velocity and transport velocity. Fluidization conditions are substantially different from those found in non-turbulent dense beds or transport beds. Although fluid bed reactors are preferred for both the high severity and low severity reaction zones, it is within the scope of the present process to utilize riser reactors in either one or both zones.

In an alternative embodiment, a portion of partially deactivated catalyst particles from the secondary low severity fluidized bed reaction zone is withdrawn and then added to the primary high severity reaction zone. Catalyst flow in this manner can be employed when conditions dictate, e.g., when flow rates of feeds are such that it is more beneficial to proceed in such a manner.

It is understood that the various process conditions are given for a continuous system operating at steady state, and that substantial variations in the process are possible within the inventive concept. In the description of the invention, metric units and parts by weight are employed unless otherwise specified.

A continuous process is disclosed for upgrading lower olefins to increase gasoline yield and ease of LPG recovery. The process comprises separating a $C_2$–$C_4$ cracked olefinic gas into a primary overhead stream containing $C_2$ hydrocarbons typically having at least about 10–30 wt. % ethene and up to 20% heavier olefins and a secondary stream comprising $C_3$–$C_4$ olefinic hydrocarbons. Preferably, the primary stream is amine treated and the secondary stream is amine and Merox treated. The treated primary stream containing $C_2$ hydrocarbons is added to a primary fluidized bed reaction zone which contains solid crystalline zeolite catalyst particles in a reactor bed operating under turbulent regime high severity conditions. The treated secondary stream comprising $C_3$–$C_4$ olefinic hydrocarbons is added to a secondary fluidized bed reaction zone which contains solid crystalline zeolite catalyst particles in a reactor bed operating under turbulent regime and low severity conditions. A portion of partially deactivated catalyst particles from the primary high severity fluidized bed reaction zone is withdrawn and then added to the secondary low severity fluidized bed reaction zone. The withdrawn partially deactivated catalyst particles contact the $C_3$–$C_4$ olefinic hydrocarbons in said secondary reaction zone. After a period of contact, an amount of deactivated catalyst particles can be withdrawn from the secondary low severity fluidized bed reaction zone and added to a catalyst regeneration zone. Oxidative regeneration restores the catalytic activity to provide reactivated catalyst particles. The reactivated catalyst particles are withdrawn from the catalyst regeneration zone and at least a portion of said catalyst particles are added to the primary high severity reaction zone.

The present process further comprises withdrawing from the primary high severity reaction zone a primary effluent comprising unseparated light gas and $C_5$+ hydrocarbons boiling in the gasoline range. From the secondary low severity reaction zone a secondary effluent comprising unseparated LPG and $C_5$+ hydrocarbons boiling in the gasoline and/or distillate range is withdrawn. Primary effluent is added to a primary separation zone to obtain a noncondensible primary separation overhead stream comprising light gas and a primary separation bottoms stream comprising $C_5$+ hydrocarbons. Secondary effluent is added to a secondary separation zone to obtain a secondary separation liquid overhead stream consisting essentially of $C_3$–$C_4$ hydrocarbons substantially free of $C_2$− components and a secondary separation bottoms stream comprising $C_5$+ hydrocarbons. Both primary and secondary separation bottoms streams can be recovered as product in an integrated separation system.

The process of the present invention is an improvement on a continuous process for upgrading $C_2$–$C_4$ olefinic offgas from a fluidized catalytic cracking (FCC) unit comprising contacting $C_2$–$C_4$ olefinic hydrocarbons with solid crystalline acid zeolite catalyst particles in a fluidized reaction zone under olefins oligomerization conditions to obtain hydrocarbons boiling in the gasoline and/or distillate range. The improvement comprises obtaining a treated $C_2$–$C_4$ olefinic offgas from an FCC unit and separating said offgas in a separation zone to obtain a primary overhead stream comprising noncondensible $C_2$ hydrocarbons rich in ethene and a secondary stream comprising $C_3$–$C_4$ olefinic hydrocarbons. A primary high severity fluidized olefins oligomerization reaction zone is maintained at a predetermined pressure of about 100 kPa to 3000 kPa and a temperature of about 300° C. to 500° C. Higher operating temperatures may be employed if it is desired to convert $C_3$+ components in the primary steam to BTX. The primary reaction zone contains solid crystalline acid zeolite catalyst particles having an apparent average acid cracking activity of about 2 to 100.

A secondary low severity fluidized bed olefins oligomerization reaction zone is maintained preferably at about the same predetermined pressure as the primary reaction zone and a temperature of about 250° C. to 450° C. The secondary reaction zone contains solid crystalline acid zeolite catalyst particles having an apparent average acid cracking activity of about 1 to 50.

To the primary reaction zone is added the primary overhead stream rich in ethene. Conditions in the primary reaction zone are such that a major amount of the ethene is oligomerized to higher molecular weight hydrocarbons. Feedstock for the secondary reaction zone is the secondary stream comprising $C_3$–$C_4$ olefinic hydrocarbons.

A primary effluent comprising unseparated fuel gas and $C_5$+ hydrocarbons boiling in the gasoline range is withdrawn from the primary reaction zone; and a secondary effluent comprising $C_3$–$C_4$ saturated and unsaturated hydrocarbons and $C_5$+ hydrocarbons boiling in the gasoline and/or distillate range is withdrawn from the secondary reaction zone. An advantage of the invention is that the reaction severity is controlled to produce an effluent from the secondary reaction zone substantially free of methane and ethane cracking products so that the condensed $C_3$–$C_4$ product meet the required vapor pressure specification. Downstream fractionation requirements are therefore substantially reduced. If there is a small amount of $C_2$-alkanes present in the effluent from the secondary reaction zone, it can be substantially purged from the separation system and added to the FCC gas plant feed, primary reactor feed, or noncondensible stream from the primary reaction zone effluent at no additionally significant cost to the overall process.

A portion of partially deactivated zeolite catalyst particles is withdrawn from the primary high severity reaction zone and added to the secondary low severity reaction zone where said portion of partially deactivated catalyst particles contacts $C_3$–$C_4$ olefinic hydrocarbon feedstock under oligomerization conditions. An amount of deactivated zeolite catalyst particles is then withdrawn from the secondary low severity reaction zone and added to a catalyst regeneration zone where the deactivated catalyst particles are oxidatively regenerated to provide reactivated zeolite catalyst particles. Reactivated catalyst particles are withdrawn from the oxidative regeneration zone and at least a portion of the reactivated particles are added to the primary high severity reaction zone. In a preferred alternative embodiment, the deactivated zeolite catalyst particles are stripped in a common stripping zone before entering the catalyst regeneration zone.

Broadly, the present process is a continuous process for upgrading a $C_2$–$C_4$ olefinic hydrocarbon stream to more valuable $C_5$+ hydrocarbons. A $C_2$–$C_4$ olefinic hydrocarbon stream is separated into at least two reactive streams having different chemical reactivity. At least two fluidized bed reaction zones containing solid crystalline zeolite catalyst particles in a turbulent reactor bed are maintained under oligomerization reaction conditions. One of the reaction zones is maintained under high severity reaction conditions. The reactive streams are added as feedstock to the fluidized reaction zones operating in parallel. The feedstreams are added in a manner such that each reactive stream enters a separate reaction zone operating under conditions which optimize olefins oligomerization reactions for each stream. An oligomerized product is withdrawn from each of the fluidized bed reaction zones.

At least a portion of partially deactivated zeolite catalyst particles is withdrawn from the reaction zone operating under high severity oligomerization reaction conditions. The portion of withdrawn partially deactivated catalyst particles is added to at least one parallel reaction zone. A reactive stream then contacts the partially deactivated catalyst particles to provide oligomerized product and deactivated catalyst particles. An amount of deactivated catalyst particles is withdrawn from the at least one parallel reaction zone containing the added partially deactivated catalyst particles. Withdrawn deactivated catalyst particles are then added to a catalyst regeneration zone and oxidatively regenerated therein to provide reactivated catalyst particles. Reactivated catalyst particles are withdrawn from the regeneration zone and at least a portion of said particles are added to the reaction zone operated under high severity oligomerization reaction conditions.

Referring to the single FIGURE, an olefinic feedstock such as FCC main fractionator overhead product enters separation zone 2 as by line 1. The heavy products are recovered via line 80. A $C_2$ hydrocarbon stream rich in ethene is withdrawn in vapor phase as noncondensible overhead from separation zone 2 via line 3. The $C_2$ hydrocarbon stream enters high severity fluidized bed oligomerization reaction zone 4 via line 3 where oligomerizable $C_2$ hydrocarbons contact fresh shape selective acid zeolite catalyst particles under ethene oligomerization conditions. The fresh zeolite catalyst particles have an apparent average acid cracking value of about 2 to 100. In a preferred embodiment, the apparent average acid cracking value is about 3 to 7. Deactivated catalyst particles are withdrawn from reaction zone 4 via line 30. Either a portion of or all the deactivated catalyst particles are added to the low severity reaction zone 6 as by line 33. A portion of deactivated catalyst can be added directly to the catalyst regeneration zone 8 via line 39. Fresh catalyst particles are added as needed to high severity reaction zone 4 as by line 31. Oxidatively regenerated catalyst particles are added to high severity reaction zone 4 as by line 37.

From separation zone 2 is withdrawn a treated liquid bottoms stream comprising $C_3$–$C_4$ olefinic hydrocarbons. The liquid bottoms stream is added via line 5 to a fluidized reaction zone operated under low severity oligomerization conditions. Such conditions typically do not favor very high conversion of ethene. $C_3$–$C_4$ olefins contact solid acid zeolite catalyst particles in the reaction zone 6. The apparent average acid cracking value of the catalyst particles in reaction zone 6 is about 1 to 50. In reaction zone 6 olefins such as reactant ropene and butene are efficiently upgraded to $C_5$+ hydrocarbons boiling in the gasoline range. Only a minor amount of propene undergoes cracking to less valuable methane, ethene and ethane. Depending on the operating conditions various amounts of distillate components are also produced.

Deactivated catalyst particles are withdrawn from reaction zone 6 and added to common catalyst regeneration unit 8 via line 35. Oligomerized effluent is withdrawn from reaction zone 6 via line 9. Effluent enters heat exchange unit 16 where it is cooled prior to entering separation zone 12 as by line 13. From separation zone 12 is withdrawn a liquid overhead comprising $C_3$–$C_4$ saturated and unsaturated hydrocarbons via line 19 and a liquid bottoms stream comprising $C_5$+ hydrocarbons boiling in the gasoline and/or distillate range as by line 21.

Oligomerized effluent is withdrawn from reaction zone 4 via line 7 and enters heat exchanger 14 for cooling. Effluent then enters separation zone 10 via line 11 to obtain a noncondensible overhead comprising fuel gas which is withdrawn via line 15 and a liquid bottoms stream comprising $C_5$+ gasoline-range hydrocarbons as by line 17.

Alternatively, the hydrocarbon stream of line 17 can be recycled to fractionation zone 2 to be separated into light gas, $C_3$–$C_4$ hydrocarbons, and a gasoline fraction. The $C_3$–$C_4$ hydrocarbons can be added to reaction zone 6 for further upgrading. In a preferred embodiment, separation zone 10 operates to produce a relatively pure stream 17 lean in $C_2$–hydrocarbons, which stream is added to common fractionator 12.

In the case where catalyst fines are allowed to leave the primary and secondary reaction zones unseparated from the reaction zone effluents, a common liquid filter can be employed to remove catalyst fines from the combined gasoline product stream.

In an alternative embodiment, $C_5$+ hydrocarbons withdrawn from separation zone 12 can be added to a fixed bed MOGD (Mobil Olefins to Gasoline) reactor containing solid crystalline acid zeolite catalyst such as ZSM-5 to obtain a product comprising $C_{10}$+ hydrocarbons boiling in the distillate range.

$C_3$–$C_4$ saturated and unsaturated hydrocarbons withdrawn from separation zone 12 via line 19 can be recycled to separation zone 2, to reaction zone 4, or directly to reaction zone 6 for upgrading to more valuable $C_5$+ hydrocarbon product. Alternatively, the $C_3$–$C_4$ hydrocarbons withdrawn via line 19 can be sent to a dehydrogenation reaction zone for upgrading to olefins which could be used to make ethers or recycled to zone 6.

Generally speaking, the present process is not limited to processing only an ethene fraction in a high severity reaction zone and specifically a propene/butene-containing fraction in a lower severity reaction zone. Broadly, any light olefins-containing feed can be added to either reaction zone, so long as one reaction zone is operated at a significantly higher severity than the other zone. An alternative example is a process comprising adding a propene-rich feed to a primary reaction zone; withdrawing from the primary reaction zone a primary effluent comprising $C_5$+ hydrocarbons and unreacted propene; adding at least a portion of the primary effluent to a feed rich in n-butene to obtain a mixed feedstream containing n-butene, $C_5$+ hydrocarbons and propene; and adding the mixed feedstream to a secondary reaction zone operated at higher severity than said primary reaction zone. Other alternative arrangements are obvious to one skilled in the art and are within the scope of the present invention.

While the invention has been described by specific examples and embodiments, there is no intent to limit the inventive concept except as set forth in the following claims.

We claim:

1. A continuous process for upgrading lower olefins to increase gasoline yield and ease of LPG recovery, comprising:

separating a $C_2$–$C_4$ cracked olefinic gas into a primary overhead stream containing $C_2$ hydrocarbons having at least about 10% ethene and a secondary stream comprising a major amount of $C_3$–$C_4$ olefinic hydrocarbons;

adding the primary stream containing $C_2$ hydrocarbons to a primary fluidized reaction zone comprising solid crystalline zeolite catalyst particles in a reactor bed operating under high severity conditions;

adding the secondary stream comprising $C_3$–$C_4$ olefinic hydrocarbons to a secondary fluidized bed reaction zone comprising solid crystalline zeolite catalyst particles in a reactor bed operating under turbulent regime low severity conditions;

withdrawing a portion of partially deactivated catalyst particles from the primary high severity fluidized bed reaction zone;

adding withdrawn partially deactivated catalyst particles to the secondary low severity fluidized bed reaction zone, thereby contacting $C_3$–$C_4$ olefinic hydrocarbons with the partially deactivated catalyst particles;

withdrawing an amount of deactivated catalyst particles from the secondary low severity fluidized bed reaction zone;

adding withdrawn deactivated catalyst particles to a catalyst regeneration zone; oxidatively regenerating deactivated catalyst particles to provide reactivated catalyst particles;

withdrawing reactivated catalyst particles from regeneration zone; and adding at least a portion of reactivated catalyst particles to the primary high severity reaction zone.

2. A process according to claim 1 wherein the $C_2$–$C_4$ cracked olefinic gas comprises an offgas from a fluidized catalytic cracking (FCC) unit.

3. A process according to claim 1 wherein the solid crystalline zeolite catalyst particles in the primary reaction zone comprise a zeolite having the structure of ZSM-5.

4. A process according to claim 3 wherein the zeolite catalyst comprises ZSM-5.

5. A process according to claim 1 wherein the zeolite catalyst particles in the primary reaction zone have an apparent average acid cracking value of about 2 to 30 and a silica:alumina molar ratio of about 25:1 to 70:1.

6. A process according to claim 1 wherein the primary reaction zone is operated at a pressure of about 100 kPa to 3000 kPa and a temperature of about 300° C. to 700° C., and wherein the $C_2$ hydrocarbon stream contains about 10–30 wt. % ethylene.

7. A process according to claim 1 wherein the zeolite catalyst particles comprise a zeolite having the structure of ZSM-5.

8. A process according to claim 7 wherein the zeolite catalyst comprises Ni-ZSM-5.

9. A process according to claim 1 wherein the zeolite catalyst particles in the secondary reaction zone have an average acid cracking value of about 1 to 15 and a silica:alumina molar ratio of about 25:1 to 70:1.

10. A process according to claim 1 wherein the secondary reaction zone is operated at about the same pressure as the primary reaction zone and a temperature of about 300° C. to 400° C.

11. A process according to claim 1 further comprising:

withdrawing from the primary high severity reaction zone a primary effluent comprising unseparated light gas and $C_5+$ hydrocarbons boiling in the gasoline range;

withdrawing from the secondary Low severity reaction zone a secondary effluent comprising unseparated LPG and $C_5+$ hydrocarbons boiling in the gasoline and/or distillate range; adding the primary effluent to a primary separation zone to obtain a noncondensible primary separation overhead stream comprising light gas and a primary separation liquid bottoms stream comprising $C_5+$ hydrocarbons;

adding the secondary effluent to a secondary separation zone to obtain a noncondensible secondary separation overhead stream consisting essentially of $C_3$–$C_4$ hydrocarbons substantially free of $C_2-$ components and a secondary separation liquid bottoms stream comprising $C_5+$ hydrocarbons; and recovering the primary separation and secondary separation liquid bottoms streams as product.

12. In a continuous process for upgrading $C_2$–$C_4$ olefinic offgas from a fluidized catalytic cracking (FCC) unit comprising contacting $C_2$–$C_4$ olefinic hydrocarbons with solid crystalline acid zeolite catalyst particles in a fluidized bed reaction zone under olefins oligomerization conditions to obtain hydrocarbons boiling in gasoline and/or distillate range, the improvement comprising:

obtaining $C_2$–$C_4$ olefinic offgas in a separation zone to obtain a primary overhead stream comprising noncondensible $C_2-$ hydrocarbons rich in ethene and a secondary stream comprising $C_3$–$C_4$ olefinic hydrocarbons;

maintaining a primary high severity olefins oligomerization reaction zone containing fluidized solid crystalline acid zeolite catalyst particles having an apparent acid cracking activity of about 2 to 30, the reaction zone operating at a pressure of about 100 kPa to 3000 kPa and a temperature of about 300° C. to 500° C.;

maintaining a secondary low severity olefins oligomerization reaction zone containing fluidized solid crystalline acid zeolite catalyst particles having an apparent average acid cracking activity of about 1 to 10, the reaction zone operating at about the same pressure as the primary reaction zone and a temperature of about 300° C. to 500° C.;

adding as a feedstock to the primary reaction zone the primary overhead stream rich in ethene;

adding to the secondary reaction zone as a feedstock the secondary stream comprising $C_2$–$C_4$ olefinic hydrocarbons;

withdrawing from the primary reaction zone a primary effluent comprising unseparated fuel gas and $C_5+$ hydrocarbons boiling in the gasoline range;

withdrawing from the secondary reaction zone a secondary effluent comprising $C_2$–$C_4$ saturated and unsaturated hydrocarbons and $C_5+$ hydrocarbons boiling in the gasoline and/or distillate range, said secondary effluent being substantially free of methane and ethane cracking products;

withdrawing from the primary high severity reaction zone a portion of partially deactivated zeolite catalyst particles;

adding the portion of withdrawn partially deactivated catalyst particles to the secondary low severity reaction zone for contacting the portion of catalyst particles with the $C_3$–$C_4$ olefinic hydrocarbon feedstock under oligomerization conditions;

withdrawing an amount of deactivated zeolite catalyst particles from the secondary low severity reaction zone;

adding the amount of withdrawn deactivated catalyst particles to a catalyst regeneraion zone;

oxidatively regenerating deactivated catalyst in the regeneration zone to provide reactivated zeolite catalyst particles;

withdrawing the reactivated catalyst particles from the regeneration zone; and adding at least a portion of reactivated catalyst particles to the primary high severity reaction zone.

13. A continuous process for upgrading a $C_2$–$C_4$ olefinic hydrocarbon stream to more valuable $C_5+$ hydrocarbons boiling in the gasoline and/or distillate range, the process comprising:

separating a $C_2$–$C_4$ olefinic hydrocarbon stream into at least two reactive streams having different chemical reactivity;

maintaining at least two fluidized bed reaction zones comprising turbulent reactor beds containing solid crystalline acid zeolite catalyst particles;

operating one of the reaction zones under high severity reaction conditions;

adding the reactive streams as feedstock to the reaction zones operating in parallel such that each reactive stream contacts catalyst particles in a separate reaction zone operated under conditions which optimize olefins oligomerization reactions for said stream;

withdrawing at least a portion of partially deactivated zeolite catalyst particles from the high severity reaction zone;

adding withdrawn catalyst particles to at least one parallel reaction zone, whereby a reactive stream contacts partially deactivated catalyst particles;

withdrawing an amount of deactivated catalyst particles from the at least one parallel reaction zone;

adding withdrawn deactivated catalyst particles to a catalyst regeneration zone;

regeneration the catalyst particles to provide reactivated catalyst particles;

withdrawing reactivated catalyst particles from the regeneration zone;

adding at least a portion of reactivated catalyst particles to the high severity reaction zone; and withdrawing oligomerized product from the fluidized bed reaction zones.

14. A process according to claim 13 wherein the solid zeolite catalyst particles in the fluidized bed reaction zone comprise ZSM-5.

15. A process according to claim 13 wherein the $C_2$–$C_4$ olefinic stream is separated into three reactive streams.

16. A process according to claim 15 wherein one of the reactive streams comprises a major amount of ethene and is substantially free of propene and butene.

17. A process according to claim 16 wherein the reactive stream comprising a major amount of ethene is added to the reaction zone comprising a turbulent reactor bed operated under high severity reaction conditions.

18. A continuous process for upgrading lower olefins comprising:

adding a primary stream comprising relatively unreactive olefins to a primary fluidized zone comprising solid crystalline zeolite catalyst particles in a reactor operating under turbulent regime conditions; adding a secondary stream comprising readily reactive olefins to a secondary fluidized reaction zone comprising solid crystalline zeolite catalyst particles in a reactor operating under turbulent regime low severity conditions; withdrawing a portion of partially deactivated catalyst particles from the primary high severity fluidized reaction zone; and adding withdrawn partially deactivated catalyst particles to the secondary low severity fluidized reaction zone, thereby containing readily reactive olefins with the partially deactivated catalyst particles.

19. The process of claim 1 wherein said primary fluided reaction zone comprises a reactor bed operating under turbulent regime conditions.

* * * * *